United States Patent [19]

Clomburg, Jr. et al.

[11] Patent Number: 4,963,163

[45] Date of Patent: Oct. 16, 1990

[54] DETERMINATION OF GASIFIER OUTLET AND QUENCH ZONE BLOCKAGE

[75] Inventors: Lloyd A. Clomburg, Jr., Houston; Otto E. Crenwelge, Jr., Katy, both of Tex.

[73] Assignee: Shell Oil Company, Houston, Tex.

[21] Appl. No.: 458,196

[22] Filed: Dec. 28, 1989

[51] Int. Cl.[5] ..... C10J 3/00; C10J 3/46

[52] U.S. Cl. ..... 48/210; 48/206; 48/DIG. 2; 252/373

[58] Field of Search ..... 48/197 R, 203, 206, 48/210, DIG. 2, DIG. 10, 69; 252/373; 266/45, 89

[56] References Cited

U.S. PATENT DOCUMENTS

| | | | |
|---|---|---|---|
| 2,716,598 | 8/1905 | Moses | 48/DIG. 2 |
| 2,971,830 | 2/1961 | Kavai et al. | 48/201 |
| 4,331,450 | 5/1982 | Elliott | 48/DIG. 2 |
| 4,834,778 | 5/1989 | Segerstron et al. | 48/210 |

*Primary Examiner*—Peter Kratz

*Attorney, Agent, or Firm*—Albert J. Adamcik

[57] ABSTRACT

A method for determining blockage of a coal gasification process gasifier outlet or quench zone by observing changes in the sound pressure between the quench zone and the gasifier is disclosed.

24 Claims, 3 Drawing Sheets

11
5
A
FFT
12
13
3
2
10
2
1
4
1
6
7

DETERMINATION OF GASIFIER OUTLET AND QUENCH ZONE BLOCKAGE

BACKGROUND OF THE INVENTION

This invention relates to the monitoring of a process for the partial oxidation of carbon-containing fuel, particularly coal, with an oxygen-containing gas in a reactor under high pressures and temperatures. In its preferred form, it relates to a process for monitoring a gasifier in which the product gas and fly ash formed is removed at the top of the gasifier and slag is removed at the bottom of the reactor.

Many carbon-containing fuels are of mineral origin, and often contain, in addition to carbon and hydrogen, varying quantities or inorganic incombustible material. The latter material is a by-product of the process of oxidation, and, depending on characteristics such as density and size of the particular particle, and the reactor configuration and conditions, may undergo a rough separation in the reactor into particles called "flyash" (lighter) and "slag" (denser). The flyash particles may be removed overhead with the product synthesis gas through a zone or conduit where the gas and particles are quenched (quench zone), while the denser materials may collect as a molten slag in the hearth of the reactor and are discharged downward through an outlet or orifice in the hearth into a water bath. In some gasification processes, product gas, slag, and flyash are removed together from one outlet, but undergo a similar separation.

A real concern in such processes is that the flyash and/or slag may collect and solidify at the outlet of the gasifier or in the area within the quench zone near the outlet to such an extent that the flow of the gas is undesirably impeded or blocked. Blockage of the gasifier outlet or quench zone represents a potentially catastrophic situation and requires shut-down of the process, an obviously unsatisfactory circumstance. The invention is directed to overcoming this problem.

SUMMARY OF THE INVENTION

Accordingly, in one embodiment, the invention relates to a procedure or process for monitoring the open cross-sectional area to detect changes therein, or for detecting the blockage, or partial blockage, of the product gas outlet, or of a section of a quench zone or conduit proximate and communicating with the outlet, of a gasifier operated under elevated temperature and pressure for partially oxidizing coal. By identifying the early existence of a partial blockage, operating conditions may be changed to prevent or inhibit further deposition or even stimulate the removal of some or all of the blockage. Also, the monitoring technique of the invention may allow identification of conditions which lead to the origination of the partial blockage, so that those conditions may be avoided in subsequent operations. More particularly, the invention relates to a process for monitoring the open cross sectional area of an outlet or quench zone to detect changes therein while quenching synthesis gas and molten flyash particles from a gasifier for the gasification of coal and while carrying out a process for the partial oxidation of coal in the gasifier, comprising (a) providing at least one first pressure transducer in said gasifier;

(b) providing at least one second pressure transducer at a locus in the quench zone proximate the outlet of the gasifier;

(c) concomitantly receiving sound pressure generated in said gasifier in both the at least one first pressure transducer and the at least one second pressure transducer, and transmitting from each of said transducers a time domain electrical signal proportionate to the amplitude of the sound pressure received by each of said respective transducers;

(d) converting said time domain signals respectively to mathematically complex signals in the frequency domain proportional to their pressure magnitude and/or phase;

(e) comparing the frequency domain signal :rom the at least one transducer in the quench zone to the frequency domain signal from the at least one transducer In the gasifier at a pre-selected frequency, and deriving a frequency response function from the comparison;

(f) comparing the frequency response function with a predetermined value.

According to the invention, in one case, in response to a deviation of the function produced in step (e) from the predetermined value, the process for the partial oxidation of coal in the gasifier is discontinued. In another case, in response to a deviation of the value produced in step (e) from the predetermined value, the partial oxidation conditions may be changed.

In its preferred embodiment, the invention relates to a process for the gasification of coal comprising (a) feeding particulate coal and oxygen to a gasifier having an enclosed reaction chamber under conditions to oxidize the coal and produce a product stream comprising synthesis gas and flyash, (b) passing the product stream from the gasifier through an outlet to a quench zone, and recovering synthesis gas;

(c) providing at least one first pressure transducer in said gasifier and at least one second pressure transducer at a locus in the quench zone proximate the outlet of the gasifier;

(d) concomitantly receiving sound pressure generated in said gasifier in both the at least one first pressure transducer and the at least one second pressure transducer, and transmitting from each of said transducers a time domain electrical signal proportionate to the amplitude of the sound pressure received by each of said respective transducers;

(e) converting said time domain signals respectively to mathematically complex signals in the frequency domain proportional to their pressure magnitude and/or phase;

(f) comparing the frequency domain signal from the at least one transducer in the quench zone to the frequency domain signal from the at least one transducer in the gasifier at a pre-selected frequency, and deriving a frequency response function from the comparison;

(g) comparing the frequency response function with a predetermined value.

In its most preferred form, the gasifier has a configuration such that the product gas containing flyash is passed through an outlet in the upper portion of the gasifier. As will be apparent, the invention utilizes characteristics of sound emanating from the gasifier or gasification zone, whether endemic or supplied by an inserted source.

DETAILED DESCRIPTION OF THE INVENTION

Figure 1:
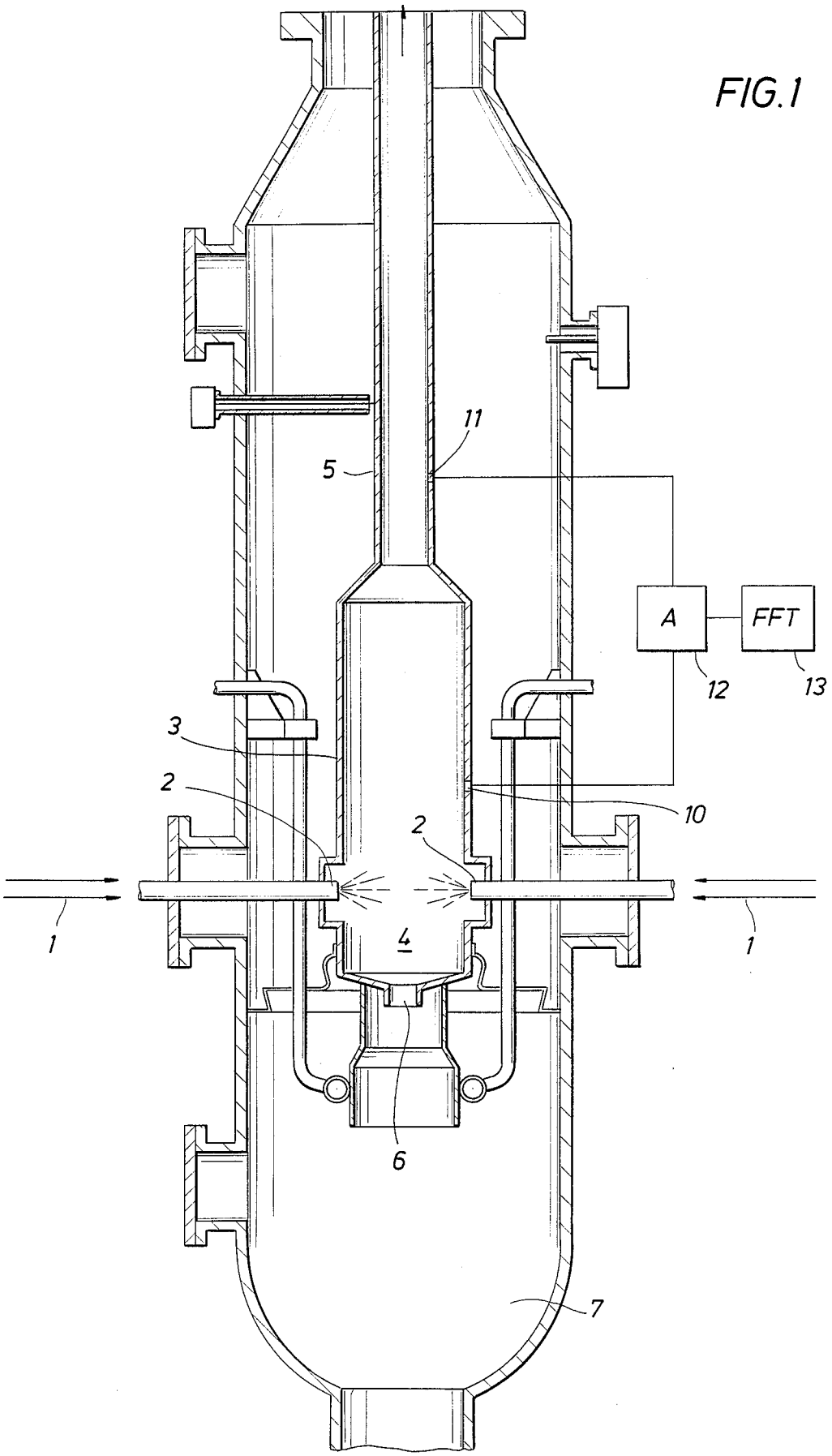

The partial combustion of coal to produce synthesis gas, which is substantially carbon monoxide and hydrogen, and particulate flyash, is well known, and a survey of known processes is given in "Ullmanns Enzyklopadie Der Technischen Chemie", vol. 10 (1958), pp. 360–458. Several such processes for the preparation of hydrogen, carbon monoxide, and flyash and slag are currently being developed. Accordingly, details of the gasification process are related only insofar as is necessary for understanding of the present invention.

In general, the gasification is carried out by partially combusting the coal with a limited volume of oxygen at a temperature normally between 800° C. and 2000° C. If a temperature of between 1050° C. and 2000° C. is employed, the product gas will contain very small amounts of gaseous side products such as tars, phenols and condensable hydrocarbons. Suitable coals include lignite, bituminous coal, sub-bituminous coal, anthracite coal, and brown coal. Lignites and bituminous coals are preferred. In order to achieve a more rapid and complete gasification, initial pulverization of the coal is preferred. Particle size is preferably selected so that 70% of the solid coal feed can pass a 200 mesh sieve. The gasification is preferably carried out in the presence of oxygen and steam, the purity of the oxygen preferably being at least 90% by volume, nitrogen, carbon dioxide and argon being permissible as impurities. If the water content of the coal is too high, the coal should be dried before use. The atmosphere will be maintained reducing by the regulation of the weight ratio of the oxygen to moisture and ash free coal in the range of 0.6 to 1.0, preferably 0.8 to 0.9. The specific details of the procedures employed form no part of the invention, but those described in U.S. Pat. No. 4,350,103 and U.S. Pat. No. 4,458,607, both incorporated herein by reference, may be employed. Although, in general, it is preferred that the ratIo between oxygen and steam be selected so that from 0 to 1.0 parts by volume of steam is present per part by volume of oxygen, the invention is applicable to processes having substantially different ratios of oxygen to steam. The oxygen used is preferably heated before being contacted with the coal, preferably to a temperature of from about 200° to 500° C.

The high temperature at which the gasification is carried out is obtained by reacting the coal with oxygen and steam in a reactor at high velocity. A preferred linear velocity of injection is from 10 to 100 meters per second, although higher or lower velocities may be employed. The pressure at which the gasification can be effected may vary between wide limits, preferably being from 1 to 200 bar. Residence times may vary widely; common residence times of from 0.2 to 20 seconds are described, with residence times of from 0.5 to 15 seconds being preferred.

After the starting materials have been converted, the reaction product, which comprises hydrogen, carbon monoxide, carbon dioxide, and water, as well as the aforementioned impurities, is removed from the reactor. This gas, which normally has a temperature between 1050° C. and 1800° C, contains the impurities mentioned and flyash, including carbon-containing solids. In order to permit removal of these materials and impurities from the gas, the reaction product stream is first quenched and cooled. A variety of elaborate techniques have been developed for quenching and cooling the gaseous stream, the techniques in the quench zone and primary heat exchange zone in general being characterized by use of a quench gas and a boiler in which steam is generated with the aid or the waste heat. In general, as indicated, the product gas is passed through an outlet at or near the top of the gasifier and into a quench zone. The quench zone is preferably a conduit which is cooled by external heat exchange, and means will be provided in the zone, such as cooling gas jets, for quenching of the product gas.

The quenched gas is then subjected to a variety of purification techniques to produce a product gas, commonly called synthesis gas, which has good fuel value as well as being suitable as a feedstock for various processes.

As mentioned, the inorganic incombustible material is separated from the fuel during the combustion of the mineral fuel. Depending on the operating conditions under which combustion takes place, in particular the temperature and the quality of the fuel, and the configuration of the gasifier, flyash will be carried along with the product gas. In the present invention, monitoring of changes in the acoustical pressure in the reactor and inside the quench zone at one or more loci near the outlet of the reactor at a pre-selected frequency allows the determination of blockage of the outlet or of the quench zone. The output voltages or signals of the transducers, after amplification in a suitable amplifying device, are processed and the frequency response function is derived and is compared with a predetermined value at the preselected frequency. In this procedure, the autopower spectral density of the amplified signal from the gasifier is computed [$S_{gg}(f)$], as is the crosspower spectral density between the amplified signals [$S_{gq}(f)$] from the gasifier location and the location outside the outlet of the gasifier. The crosspower spectral density between the gasifier location and the outside (quench) location is then divided by the autopower spectral density of the gasifier location to produce a mathematically complex frequency response function which has both magnitude and phase functions and real and imaginary functions or components. Thus, $$H_{gq}(f) = \frac{S_{gq}(f)}{S_{gg}(f)} = H_{gq}(f) \cdot \exp[i \cdot \theta_{gq}(f)] = H_{gqR}(f) + i\, H_{gqI}(f)$$

Here, the bar denotes a mathematically complex quantity, while the absence of the bar denotes a real quantity. Nevertheless, as will be appreciated by those skilled in the art, the term "frequency response function" is understood herein to encompass real and imaginary functions. Suitable standard practice techniques for such computations are described in *Random Data: Analysis and Measurement Procedures,* Bendat and Piersol, Wiley-Interscience, New York (1971), and standard equipment is available for carrying them out. It should be noted that the complex frequency response function may also be computed directly by dividing the Fourier transform of the amplified quench signal by that of the amplified gasifier signal. Also, the frequency response function magnitude may be computed by taking the square root of the ratio of the quench autospectral density to that of the gasifier. However, these latter two approaches are not ordinarily used in practice since they produce some inaccuracies. According to the invention, either or both the magnitude or phase functions derived may be used to compare with a predetermined value or previously determined analogous function(s). As used herein, a "pre-determined" value, at a pre-selected frequency, refers to an acceptable sound pressure frequency response function value. Such a value may be arrived at in more than one way, an example being the establishment of the value on start-up of the gasifier by the recording of the sound pressures at resonant frequencies before any substantial blockage can occur. Another manner of determining the pre-determined ratio is by the use of a white noise source, at non-operating conditions, such as before start-up, with suitable correlation of the value of the ratio obtained to the standard conditions of operation. The term "pre-selected", with reference to the frequency, refers to one of the normal resonant frequencies of the gasifier or harmonics thereof. Normally, the pre-selected frequency will be a narrow range rather than a point value, and is so understood herein. Since, as those skilled in the art will understand, these frequencies will vary from reactor to reactor, and are dependent on such factors as, for example, the configuration of the vessel, precise ranges of the frequency cannot be given. However, a suitable frequency may be ascertained by the white noise technique mentioned, supra. Based on the observed acoustical pressure frequency response function upon beginning the operation of the gasifier with a clean quench zone, an observed change or deviation in the frequency response function value generally indicates some percentage blockage of the quench zone. An estimate of percentage blockage may be obtained by the white noise tests mentioned, supra, by insertion of calibrated blockages into the outlet and noting the changes in magnitude and/or phase in the frequency response function. The method of the invention allows determination of the beginning of blockage before any noticeable significant frequency shift.

One advantage of the present invention is the capability of controlling the blockage of the quench zone, thus extending the time periods between shutdown of the gasifier. In response to an indication of partial blockage, the partial oxidation process conditions may be changed or varied, such as the oxygen to coal ratio. For example, the oxygen to coal ratio may be decreased (or increased) depending on other factors. Additionally, the flexibility of operating the process under various conditions, such as a range of pressures, temperatures, and types of coal which characteristically produce different amounts of flyash is achieved.

ILLUSTRATION

Figure 2:
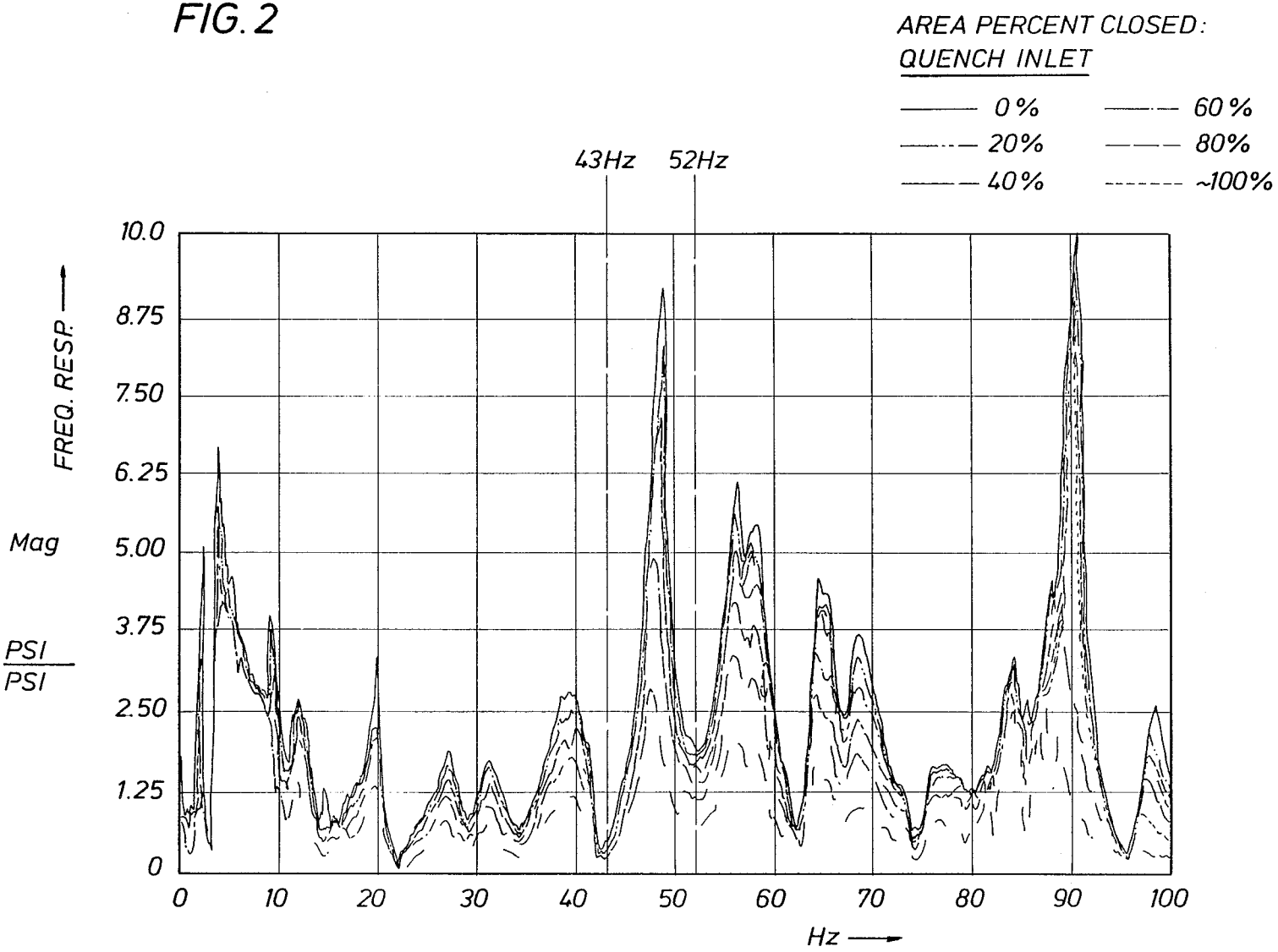
Figure 3:
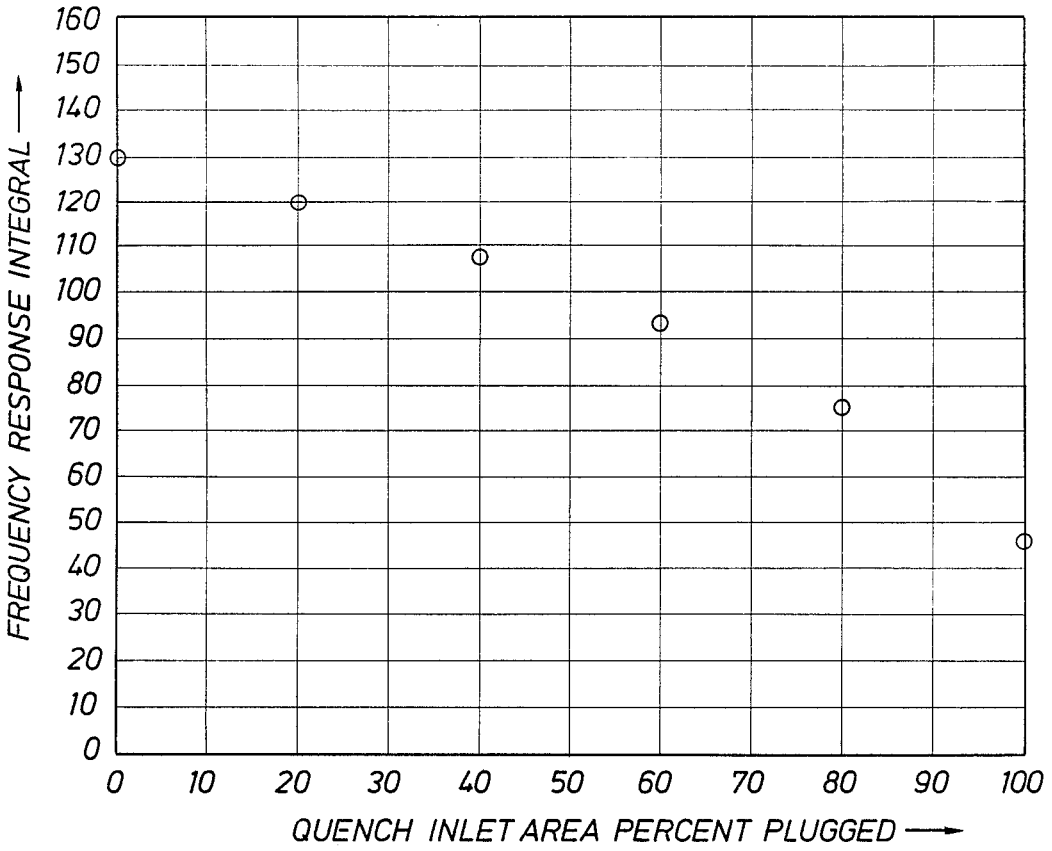

The following illustration is given with reference to the drawing. FIG. 1 illustrates schematically the use of the invention in one type of gasifier for the gasification of coal. FIG. 2 illustrates the results of a "white noise" calibration procedure, while FIG. 3 illustrates a comparator derived from such a procedure. All values are merely exemplary or calculated.

Accordingly, pulverulent coal is passed via line 1 into burners 2 of gasifier 3, the burners 2 being operated under partial oxidation conditions in enclosed reaction chamber 4 to produce synthesis gas, flyslag or flyash, and slag. Synthesis gas and flyash leave the reaction space 4 and pass from the upper portion of the gasifier to a conduit 5 where the gas and flyash are quenched, the flyash becoming solidified. The gas and flyash particles are then passed for further treatment and separation (not shown). Concomitantly, slag produced falls to the lower portion of chamber 4 and is allowed to flow by gravity through a slag discharge opening or tap 6. Molten slag drops into waterbath 7 where it is solidified, and where it may be discharged by suitable techniques.

As noted, conduit 5 must not be allowed to plug or become blocked. According to the invention, a dynamic pressure transducer is mounted in gasifier 3 at a suitable location, such as at 10. A second transducer is mounted in quench zone 5 at 11 although, preferably, a plurality of transducers are employed. Each transducer produces an oscillating voltage which is amplified in a suitable amplifying device, shown as 12, and the voltages are sent to a last Fourier transform (FFT) analyzer 13 where they are Fourier transformed into mathematically complex signals in the frequency domain. The signals are then used to compute the mathematically complex frequency response function as described, supra. This value is compared with a predetermined value. Although a spectrum of frequencies may be scanned, one of the resonant frequencies of the gasifier or gasifier-quench conduit system in the 43 to 52 Hz range may be used. This frequency may be determined on startup of the reactor, when there is assurance that the quench zone is not plugged. As experience is obtained with operation of the system, a baseline can be obtained for future comparison. Any significant deviation from the baseline of frequency response function at the resonance frequency may be interpreted as possible blockage of the quench zone.

In order to establish the relationship between sound generated in a gasifier and received in suitably located transducers (in this case microphones) in and outside the gasifier with varying percentages of plugging of the product outlet, experiments were conducted on shutdown of the gasifier and at ambient conditions. A loudspeaker (white noise) was placed at one of the burner locations in the gasifier to act as a substitute for the burners which will normally provide the noise source during operation (as mentioned, other sound sources may be relied on). The loudspeaker provided random noise of constant amplitude over a wide frequency range (5–5,000 Hz). The microphones were used to receive sound pressure, and an additional microphone was placed in front of the loudspeaker to monitor sound source characteristics. In these tests, the slagtap opening of the gasifier was fully open, but the product outlet or quench inlet was gradually "plugged" from a fully open condition, in increments of 20% closure, to a fully closed condition. The microphone signals were analyzed on the basis of frequency response function magnitude spectra.

FIG. 2 illustrates the variation in gasifier to quench frequency response function for quench inlet percent closures of 0 to IGO percent. Several narrowband frequency ranges, corresponding to resonance frequencies through the outlet and quench conduit, show orderly decreases in sound pressure amplification as the gasifier outlet or quench inlet is plugged. If a narrowband resonance range, e.g., 43 to 52 Hz, is chosen and integrated to obtain the areas under the peaks for the different values of outlet area percent plugged, the values denoted by the square symbols in FIG. 3 are obtained. From FIG. 3, then, a frequency response integral reading of 120, for example, indicates that the outlet Is at worst 20 percent plugged, assuming no plugging of the slag tap. These results may be used as a comparator for operating runs, and have been shown to be well correlated with actual high temperature gasifier runs. An equally effective comparator may be obtained by simply plotting the decreases in peak value in the 43–52 Hz range as a function of percent of quench inlet plugging.

As indicated, although the invention has been illustrated with reference to vertically disposed gasifiers wherein product gas and flyash are removed overhead, the invention is not limited to this configuration. Thus, the invention may be used with the so-called down fired configurations wherein the transducers would be suitably located near any location at which plugging might occur.

What is claimed is:

1. A process for monitoring the open cross sectional area of the outlet, or a section of a quench zone or conduit proximate to and communicating with the outlet, to detect changes therein, of a gasifier operated under elevated temperature and pressure for partially oxidizing coal, while quenching synthesis gas and molten flyash particles from said gasifier and while carrying out a process for the partial oxidation of coal in the gasifier, comprising (a) providing at least one first pressure transducer in said gasifier;

(b) providing at least one second pressure transducer at a locus in the quench zone proximate the outlet of the gasifier;

(c) concomitantly receiving sound pressure generated in said gasifier in both the at least one first pressure transducer and the at least one second pressure transducer, and transmitting from each of said transducers a time domain electrical signal proportionate to the amplitude of the sound pressure received by each of said respective transducers;

(d) converting said time domain signals respectively to mathematically complex signals in the frequency domain proportional to their pressure magnitudes;

(e) comparing the frequency domain signal from the at least one transducer in the quench zone to the frequency domain signal from the at least one transducer in the gasifier at a pre-selected frequency, and deriving a frequency response function from the comparison;

(f) comparing the magnitude of said frequency response function with a predetermined value.

2. The process of claim 1 wherein the outlet is in the upper portion of the gasifier.

3. The process of claim 2 wherein, in resPonse to a deviation of the value produced in step (e) from the predetermined value, the process for the partial oxidation of coal in the gasifier is discontinued.

4. The process of claim 1 wherein, in response to a deviation in the value produced in step (e) from the predetermined value, the oxygen to coal ratio of the process is changed.

5. A process for the gasification of coal comprising (a) feeding particulate coal and oxygen to a gasifier having an enclosed reaction chamber under conditions to oxidize the coal and produce a product stream comprising synthesis gas and flyash, (b) passing the product stream from the gasifier through an outlet to a quench zone, and recovering synthesis gas;

(c) providing at least one first pressure transducer in said gasifier and at least one second pressure transducer at a locus in the quench zone proximate the outlet of the gasifier;

(d) concomitantly receiving sound pressure generated in said gasifier in both the at least one first pressure transducer and the at least one second pressure transducer, and transmitting from each of said transducers a time domain electrical signal proportionate to the amplitude of the sound pressure received by each of said respective transducers;

(e) converting said time domain signals respectively to mathematically complex signals in the frequency domain proportional to their pressure magnitudes;

(f) comparing the frequency domain signal from the at least one transducer in the quench zone to the frequency domain signal from the at least one transducer in the gasifier at a pre-selected frequency, and deriving a frequency response function from :he comparison;

(g) comparing the magnitude of said function with a predetermined value.

6. The process of claim 5 wherein the outlet is in the upper portion of the gasifier.

7. The process of claim 6 wherein, in response to a deviation in the value produced in step (f) from the predetermined value, the process for the partial oxidation of coal in the gasifier is discontinued.

8. The process of claim 6 wherein, in response to a deviation in the value produced in step (f) from the predetermined value, the oxygen to coal ratio of the coal fed to the gasifier is changed.

9. A process for monitoring the open cross sectional area of the outlet, or a section of a quench zone or conduit proximate to and communicating with the outlet, to detect changes therein, of a gasifier operated under elevated temperature and pressure for partially oxidizing coal, while quenching synthesis gas and molten flyash particles from said gasifier and while carrying out a process for the partial oxidation of coal in the gasifier, comprising (a) providing at least one first pressure transducer in said gasifier;

(b) providing at least one second pressure transducer at a locus in the quench zone proximate the outlet of the gasifier;

(c) concomitantly receiving sound pressure generated in said gasifier in both the at least one first pressure transducer and the at least one second pressure transducer, and transmitting from each of said transducers a time domain electrical signal proportionate to the amplitude of the sound pressure received by each of said respective transducers;

(d) converting said time domain signals respectively to complex signals in the frequency domain proportional to their pressure phases;

(e) comparing the frequency domain signal from the at least one transducer in the quench zone to the frequency domain signal from the at least one transducer in the gasifier at a pre-selected frequency, and deriving a frequency response function from the comparison;

(f) comparing the phase of said frequency response function with a predetermined value.

10. The process of claim 9 wherein the outlet is in the upper portion of the gasifier.

11. The process of claim 10 wherein, in response to a deviation of the value produced in step (e) from the predetermined value, the process for the partial oxidation of coal in the gasifier is discontinued.

12. The process of claim 10 wherein, in response to a deviation in the value produced in step (e) from the predetermined value, the oxygen to coal ratio of the process is changed.

13. A process for the gasification of coal comprising
(a) feeding particulate coal and oxygen to a gasifier having an enclosed reaction chamber under conditions to oxidize the coal and produce a product stream comprising synthesis gas and flyash,
(b) passing the product stream from the gasifier through an outlet to a quench zone, and recovering synthesis gas;
(c) providing at least one first pressure transducer in said gasifier and at least one second pressure transducer at a locus in the quench zone proximate the outlet of the gasifier;
(d) concomitantly receiving sound pressure generated in said gasifier in both the at least one first pressure transducer and the at least one second pressure transducer, and transmitting from each of said transducers a time domain electrical signal proportionate to the amplitude of the sound pressure received by each of said respective transducers;
(e) converting said time domain signals respectively to mathematically complex signals in the frequency domain proportional to their pressure phases;
(f) comparing the frequency domain signal from the at least one transducer in the quench zone to the frequency domain signal from the at least one transducer in the gasifier at a pre-selected frequency, and deriving a frequency response function from the comparison;
(g) comparing the phase of said function with a predetermined value.

14. The process of claim 13 wherein the outlet is in the upper portion of the gasifier.

15. The process of claim 14 wherein, in response to a deviation in the value produced in step (f) from the predetermined value, the process for the partial oxidation of coal in the gasifier is discontinued.

16. The process of claim 14 wherein, in response to a deviation in the value produced in step (f) from the predetermined value, the oxygen to coal ratio of the process is changed.

17. A process for monitoring the open cross sectional area of the outlet, or a section of a quench zone or conduit proximate to and communicating with the outlet, to detect changes therein, of a gasifier operated under elevated temperature and pressure for partially oxidizing coal, while quenching synthesis gas and molten flyash particles from said gasifier and while carrying out a process for the partial oxidation of coal in the gasifier, comprising
(a) providing at least one first pressure transducer in said gasifier;
(b) providing at least one second pressure transducer at a locus in the quench zone proximate the outlet of the gasifier;
(c) concomitantly receiving sound pressure generated in said gasifier in both the at least one first pressure transducer and the at least one second pressure transducer, and transmitting from each of said transducers a time domain electrical signal proportionate to the amplitude of the sound pressure received by each of said respective transducers;
(d) converting said time domain signals respectively to mathematically complex signals in the frequency domain proportional to their pressure magnitudes and phases;
(e) comparing the frequency domain signal from the at least one transducer in the quench zone to the frequency domain signal from the at least one transducer in the gasifier at a pre-selected frequency, and deriving a frequency response function from the comparison;
(f) comparing the magnitude and phase of said frequency response function with a predetermined value.

18. The process of claim 17 wherein the outlet is in the upper portion of the gasifier.

19. The process of claim 18 wherein, in response to a deviation of the produced in step (e) from the predetermined value, the process for the value partial oxidation of coal in the gasifier is discontinued.

20. The process of claim 18 wherein, in response to a deviation in the value produced in step (e) from the predetermined value, the oxygen to coal ratio of the process is changed.

21. A process for the gasification of coal comprising
(a) feeding particulate coal and oxygen to a gasifier having an enclosed reaction chamber under conditions to oxidize the coal and produce a product stream comprising synthesis gas and flyash,
(b) passing the product stream from the gasifier through an outlet to a quench zone, and recovering synthesis gas;
(c) providing at least one first pressure transducer in said gasifier and at least one second pressure transducer at a locus in the quench zone proximate the outlet of the gasifier;
(d) concomitantly receiving sound pressure generated in said gasifier in both the at least one first pressure transducer and the at least one second pressure transducer, and transmitting from each of said transducers a time domain electrical signal proportionate to the amplitude of the sound pressure received by each of said respective transducers;
(e) converting said time domain signals respectively to mathematically complex signals in the frequency domain proportional to their pressure magnitudes and phases;
(f) comparing the frequency domain signal from the at least one transducer in the quench zone to the frequency domain signal from the at least one transducer in the gasifier at a pre-selected frequency, and deriving a frequency response function from the comparison;
(g) comparing the magnitude and phase of said function with a predetermined value.

22. The process of claim 21 wherein the outlet is in the upper portion of the gasifier.

23. The process of claim 22 wherein, in response to a deviation in the value produced in step (f) from the redetermined value the process for the partial oxidation of coal in the gasifier is discontinued.

24. The process of claim 22 wherein, in response to a deviation in the value produced in step (f) from the predetermined value, the oxygen to coal ratio of the process is changed.

* * * * *